US009555424B2

(12) United States Patent
Saito et al.

(10) Patent No.: US 9,555,424 B2
(45) Date of Patent: Jan. 31, 2017

(54) AIRBRUSH

(71) Applicant: ANEST IWATA Corporation, Yokohama-shi, Kanagawa (JP)

(72) Inventors: Ikuko Saito, Yokohama (JP); Takahiro Ikeda, Yokohama (JP)

(73) Assignee: ANEST IWATA CORPORATION, Yokohama-shi, Kanagawa (JP)

( * ) Notice: Subject to any disclaimer, the term of this patent is extended or adjusted under 35 U.S.C. 154(b) by 229 days.

(21) Appl. No.: 14/274,993

(22) Filed: May 12, 2014

(65) Prior Publication Data

US 2014/0339338 A1 Nov. 20, 2014

(30) Foreign Application Priority Data

May 14, 2013 (JP) ..... 2013-102602

(51) Int. Cl.

| | |
|---|---|
| ***A62C 5/00*** | (2006.01) |
| ***B05B 7/02*** | (2006.01) |
| ***B05B 15/00*** | (2006.01) |
| ***B43K 8/00*** | (2006.01) |
| *B05B 7/24* | (2006.01) |

(52) U.S. Cl.

CPC ..... *B05B 7/02* (2013.01); *B05B 15/001* (2013.01); *B43K 8/006* (2013.01); *B05B 7/2435* (2013.01); *B05B 7/2478* (2013.01)

(58) Field of Classification Search

CPC ..... B05B 7/02; B05B 15/001; B05B 7/2405; B05B 7/2435; B05B 7/2478; B43K 8/006

USPC ..... 239/398, 413, 414, 407, 569

See application file for complete search history.

(56) References Cited

U.S. PATENT DOCUMENTS

| | | | | |
|---|---|---|---|---|
| 2,460,529 | A * | 2/1949 | Paasche | B05B 7/1209 137/636 |
| 2004/0213627 | A1* | 10/2004 | Marschand | B43K 8/003 401/202 |
| 2012/0217318 | A1 | 8/2012 | Mehta | |

FOREIGN PATENT DOCUMENTS

| | | | |
|---|---|---|---|
| EP | 1479529 | A2 | 11/2004 |
| JP | 2000-140719 | A | 5/2000 |

OTHER PUBLICATIONS

European Search Report dated Aug. 13, 2014 issued in European Patent Application No. 14168145.2.

European Search Report dated Jul. 7, 2014 issued in European Patent Application No. 12741921.6.

* cited by examiner

*Primary Examiner* — Justin Jonaitis

(74) *Attorney, Agent, or Firm* — Drinker Biddle & Reath LLP

(57) ABSTRACT

Provided is an airbrush in which a needle cap separated from a nozzle is not easily lost. The airbrush includes: an airbrush body; a nozzle that is provided at a tip of the airbrush body so as to spray paint and air; a needle cap that is separably attached to the nozzle; and a needle cap attachment portion that is provided at a rear end of the airbrush body so as to temporarily attach the needle cap separated from the nozzle thereto.

1 Claim, 9 Drawing Sheets

AIRBRUSH

CROSS-REFERENCE TO RELATED APPLICATIONS

This application is based upon and claims the benefit of priority from Japanese Patent Application No. 2013-102602, filed May 14, 2013, the entire contents of which are incorporated herein by reference.

TECHNICAL FIELD

The present invention relates to an airbrush, and particularly, to an airbrush that includes a needle cap provided at a tip of a nozzle.

BACKGROUND

An airbrush is a tool that splashes paint in the form of mist by compressed air, and may simply perform an even painting operation which is not easily performed in a brush.

For example, as disclosed in Patent Document 1 , such an airbrush includes an airbrush body that is substantially formed in a pencil shape. The tip of the airbrush body is provided with a nozzle that sprays paint and air. A paint container is provided in the tipper portion of the airbrush body of the rear portion of the nozzle. Paint inside the paint container is led into the nozzle by the operation of an operation rod to be described later. The substantial center of the airbrush body is provided with an air supply hole that supplies compressed air and the operation rod that leads the compressed air supplied from the air supply hole to the outer periphery of the nozzle. A needle is provided inside an axial portion of the airbrush body so that the tip of the needle is biased so as to seal a paint spray hole of the nozzle. The sealing may be released when the needle retreats by the operation of the above-described operation rod.

In the airbrush with such a configuration, when the operation rod is pushed toward the airbrush body, the compressed air from the air supply hole is sprayed along the outer periphery of the nozzle. Further, when the operation rod moves backward, paint is sprayed through the paint spray hole of the nozzle of which the sealing by the needle is released.

Here, the sealing of the paint spray hole of the nozzle by the needle is performed by, for example, a valve structure in which the tip of the needle penetrates the paint spray hole of the nozzle so as to be freely extracted therefrom and inserted thereinto. When the tip of the nozzle through which the needle protrudes from the paint spray hole contacts a painting subject or the like, the needle is easily damaged, bent, or deformed, and hence a problem arises in the line thickness or the spraying direction of the paint. For this reason, the tip of the nozzle is provided with a needle cap that protects the needle.

[Patent Document 1] JP 2000-140719 A

SUMMARY

In the airbrush with such a configuration, for example, when an extra fine line is depicted in painting or the like, there is a case in which the needle cap is separated from the nozzle and the tip of the nozzle approaches a subject painting surface as close as possible so as to depict the extra fine line. In this ease, since the nozzle cap separated from the nozzle has a comparatively small size, a problem arises in that the nozzle cap is easily lost. Further, the airbrush is an application device that is used in the case of painting or nail art that requires high artistic quality and designability. For this reason, the airbrush body also requires high decoration appearance.

The present invention is made in view of such circumstances, and an object thereof is to provide an airbrush in which a needle cap separated from a nozzle is not easily lost and decoration appearance is not degraded.

The present invention is understood by the following configurations.

(1) An airbrush of the present invention includes: an airbrush body; a nozzle that is provided at a tip of the airbrush body so as to spray paint and air; a needle cap that is separably attached to the nozzle; and a needle cap attachment portion that is provided at a rear end of the airbrush body so as to temporarily attach the needle cap separated from the nozzle thereto.

(2) In the airbrush of the present invention with the configuration (1), the needle cap attachment portion includes a protrusion provided with means for temporarily attaching the needle cap to the outer periphery thereof.

(3) In the airbrush of the present invention with the configuration (2), the inner periphery of the needle cap is provided with a female screw threaded into a male screw formed in the outer periphery of the nozzle, and the outer periphery of the protrusion is provided with a male screw threaded into the female screw of the needle cap.

(4) In the airbrush of the present invention with the configuration (3), the needle cap attachment portion further includes an outer cylindrical body that surrounds the protrusion, an inner cylindrical body that is disposed between the outer cylindrical body and the protrusion, and a coil spring that is disposed between the airbrush body and the inner cylindrical body, and when the inner cylindrical body is pushed toward the airbrush body against a biasing force of the coil spring, the male screw of the protrusion is exposed.

(5) In the airbrush of the present invention with the configuration (2), the inner periphery of the needle cap is provided with a convex portion that is fitted to a concave portion formed in the outer periphery of the nozzle, and the outer periphery of the protrusion is provided with a concave portion that is fitted to the convex portion of the needle cap.

(6) In the airbrush of the present invention with the configuration (5), the needle cap attachment portion further includes an outer cylindrical body that surrounds the protrusion, an inner cylindrical body that is disposed between the outer cylindrical body and the protrusion, and a coil spring that is disposed between the airbrush body and the inner cylindrical body, and when the inner cylindrical body is pushed toward the airbrush body against a biasing force of the coil spring, the concave portion of the protrusion and the convex portion in the periphery thereof are exposed, (7) In the airbrush of the present invention with the configuration (1), the needle cap includes a magnet, the magnet is formed so as to have any one of N and S magnetic poles with respect to the nozzle and the attachment side of the needle cap attachment portion, the nozzle is formed so as to have a magnetic pole opposite to the magnetic pole of the magnet of the needle cap, and the needle cap attachment portion is formed so as to have a magnetic pole opposite to the magnetic pole of the magnet of the needle cap.

(8) In the airbrush of the present invention with the configuration (1), the needle cap includes a magnet, the magnet is formed so as to have any one of N and S magnetic poles with respect to the nozzle and the attachment side of the needle cap attachment portion, the nozzle is formed of a magnetic body such as iron, and the needle cap attachment portion is formed of a magnetic body such as iron.

According to the airbrush with such a configuration, since the needle cap separated from the nozzle may be temporarily attached to the needle cap attachment portion, the needle cap may not be easily lost.

DETAILED DESCRIPTION

Figure 1:
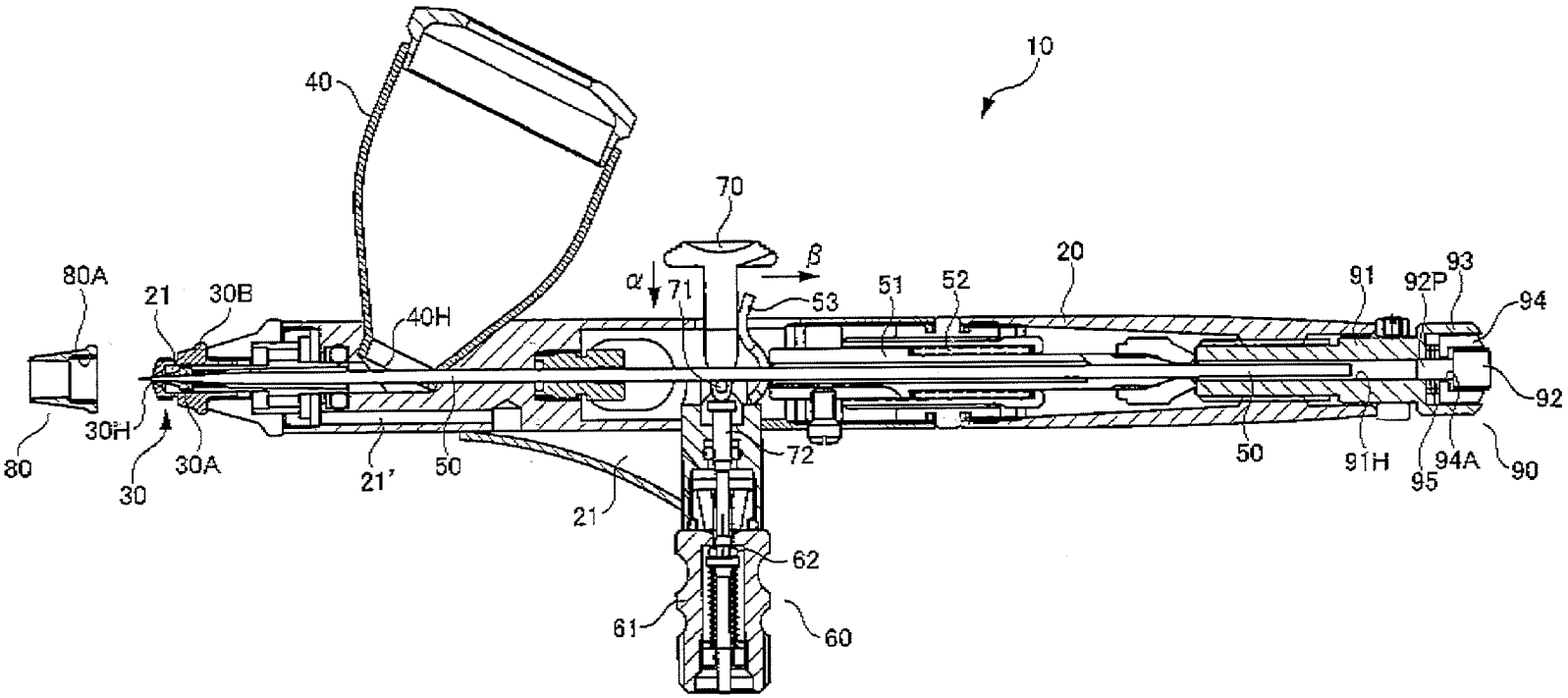
FIG. 1 is a cross-sectional view illustrating a schematic entire configuration of an airbrush according to some embodiments of the present invention.

Hereinafter, a mode for carrying out the present invention (hereinafter, an embodiment) will be described in detail by referring to the accompanying drawings. Furthermore, the same reference numerals are given to the same components in the entire description of the embodiments.

(First Embodiment)

<Entire Configuration>

FIG. 1 is a cross-sectional view illustrating a schematic entire configuration of an airbrush of the present invention. An airbrush 10 illustrated in FIG. 1 includes an airbrush body 20 that is substantially formed in a pencil shape. That is, the airbrush body 20 is formed in a rod shape that substantially extends in a straight line shape, and is handled such that the airbrush body is held like a pencil. A paint spray nozzle 30A is attached to the tapered tip of the airbrush body 20. A paint container 40 is provided in the upper portion of the rear portion of the paint spray nozzle 30A. Liquid paint (not illustrated) is accommodated in the paint container 40, and the paint is led into the paint spray nozzle 30A through a hole 40H formed in the bottom surface of the paint container 40. Furthermore, a paint spray hole 30H is formed in the tip of the paint spray nozzle 30A. The paint spray hole 30H is normally sealed by a tip of a needle 50 to be described later.

Further, the lower portion of the intermediate portion of the airbrush body 20 is provided with an air supply hole 60 to which compressed air is supplied. The air supply hole 60 is formed as, for example, a connection tube 61 that is connected to a compressed air supply hose (not illustrated), and includes an air supply valve 62 formed therein. The air supply valve 62 may be opened by an operation in which an operation rod 70 provided at the upper portion opposite to the air supply hole 60 of the airbrush body 20 is pushed toward the airbrush body 20 (in a direction a of the drawing).

A push rod 72 is connected to the tip of the operation rod 70 through a pivot shaft 71. When the push rod 72 is fitted to the axial portion of the connection tube 61, the operation rod 70 is supported in a pushable manner. The tip of the push rod 72 comes into contact with the air supply valve 62. The air supply valve 62 is opened by an operation in which the operation rod 70 is pushed. Then, the compressed air that flows from the air supply hole 60 by the operation of opening the air supply valve 62 passes through air passages 21, 21', and 21" formed inside the airbrush body 20, and is sprayed along the outer periphery of the paint spray nozzle 30A. An air spray nozzle 30B is provided so as to surround the paint spray nozzle 30A. The compressed air is sprayed through a gap between the paint spray nozzle 30A and the air spray nozzle 30B. In the present specification, both the paint spray nozzle 30A and the air spray nozzle 30B may be simply referred to as a nozzle 30.

The needle 50 is disposed inside the airbrush body 20 so as to be slidable along the axial portion, and the needle 50 may be retracted by the operation of the operation rod 70. That is, the operation rod 70 may be tilted backward (in a direction β of the drawing) around the pivot shaft 71. By the tilting movement of the operation rod 70, the needle 50 and a needle chuck 51 may be slid backward. The needle chuck 51 is fitted to the axial portion of the rear portion of the airbrush body 20. When the needle 50 is inserted through the needle chuck 51, the needle chuck 51 supports the needle 50. By the above-described operation of the operation rod 70, the sealing of the paint spray nozzle 30A using the needle 50 is released, so that the compressed air is sprayed from the air spray nozzle 30B and the paint from the paint container 40 is sprayed from the paint spray hole 30H of the paint spray nozzle 30A.

Here, the sealing of the paint spray hole 30H of the paint spray nozzle 30A using the needle 50 is performed by, for example, a valve structure in which the tip of the needle 50 penetrates the paint spray hole 30H of the paint spray nozzle 30A so that the tip may be inserted thereinto and extracted therefrom. For this reason, the tip of the nozzle 30 through which the needle 50 protrudes from the paint spray hole 30H is provided with a needle cap 80 that protects the needle 50. The needle cap 80 is separably attached to the nozzle 30 (the air spray nozzle 30B) by, for example, threading. The needle cap 80 is normally attached to the nozzle 30. For example, when an extra fine line is depicted in painting or the like, there is a case in which the needle cap 80 is separated from the nozzle 30 and the tip of the nozzle 30 is made to approach a subject painting surface as close as possible.

The needle chuck 51 includes a coil spring 52 therein, so that the needle chuck is constantly biased forward by the repelling force of the coil spring 52. An operation plate 53 substantially having an S-shape is interposed between the front end of the needle chuck 51 and the operation rod 70. When the operation rod 70 is tilted backward, the needle chuck 51 and the needle 50 may be slid backward through the operation plate 53. The rear end of the airbrush body 20 is provided with a needle cap attachment portion 90. here, the needle cap 80 will be described in detail prior to the description of the needle cap attachment portion 90.

<Needle Cap 80>

Figure 2A:
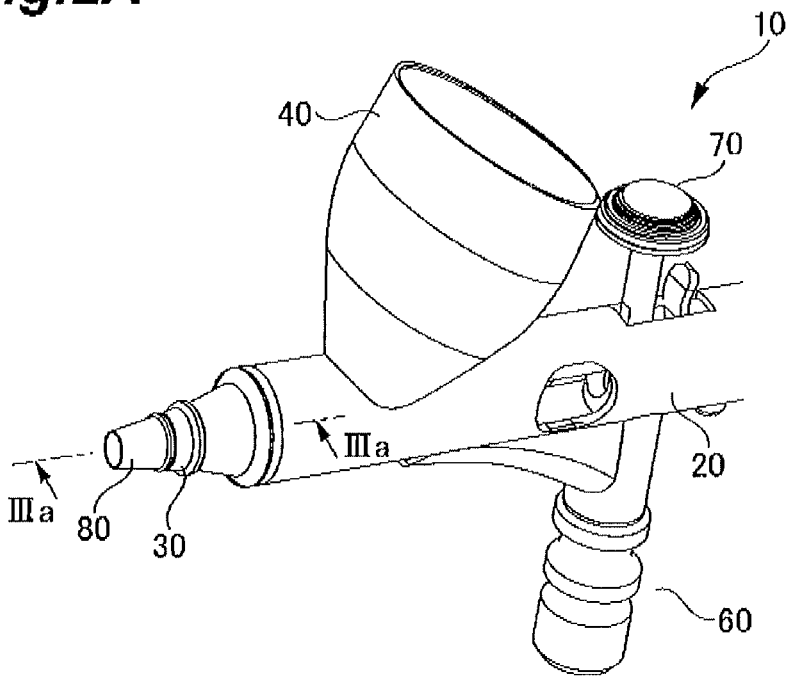
FIGS. 2A and 2B are perspective views illustrating a needle cap that is separably attached to a nozzle of an airbrush.
Figure 2B:
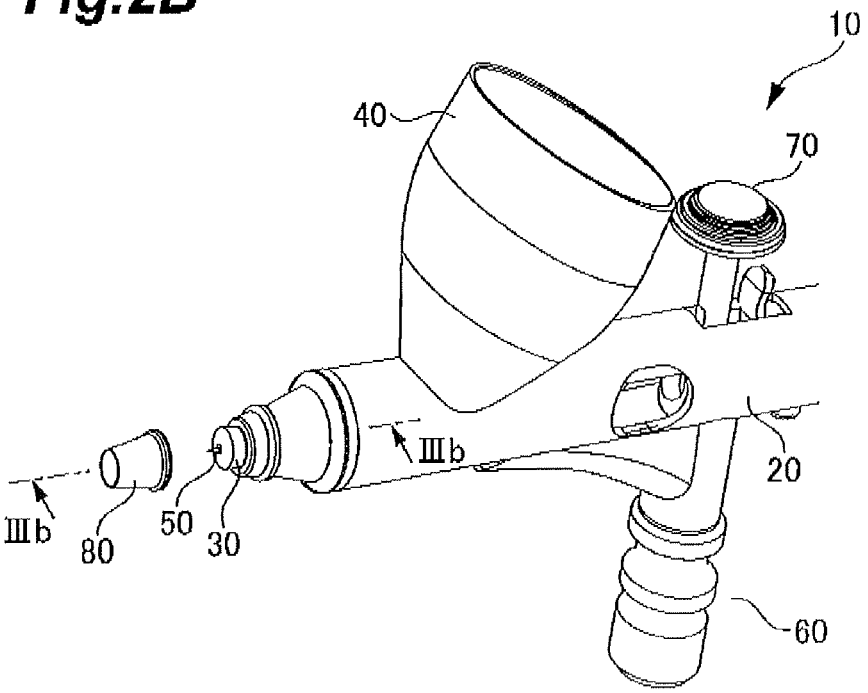

FIGS. 2A and 2B are perspective views illustrating the needle cap 80 that is separably attached to the nozzle 30 of the airbrush 10.

FIG. 2A illustrates a case where the needle cap 80 is attached to the nozzle 30, and FIG. 2B illustrates a case where the needle cap 80 is separated from the nozzle 30.

As obvious from FIGS. 2A and 2B, the needle cap 80 is substantially formed as a cylindrical member. As described above, the airbrush 10 is normally used while the needle cap 80 is attached to the nozzle 30 as illustrated in FIG. 2A. This is because the needle 50 of the tip of the nozzle 30 is protected by the needle cap 80. However, for example, when an extra fine line is depicted in painting or the like, there is a case in which the needle cap 80 is separated from the nozzle 30 and the tip of the nozzle 30 is made to approach the subject painting surface as close as possible as illustrated in FIG. 2B.

Figure 3A:
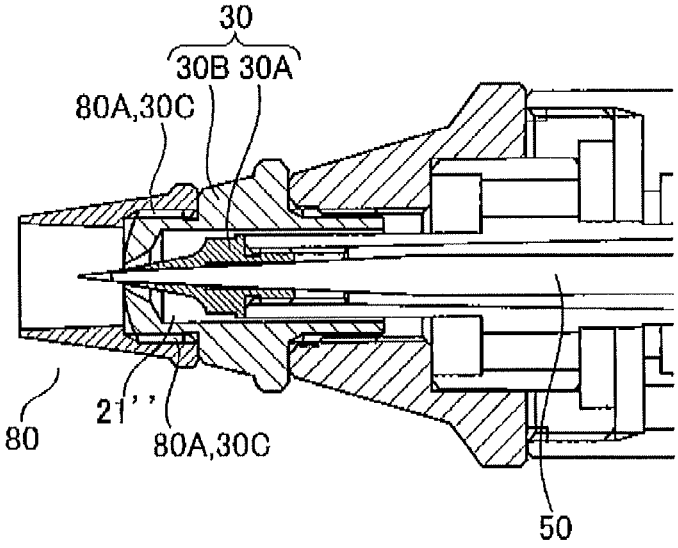
FIG. 3A is a cross-sectional view taken along the line IIIa-IIIa of FIG. 2A.
Figure 3B:
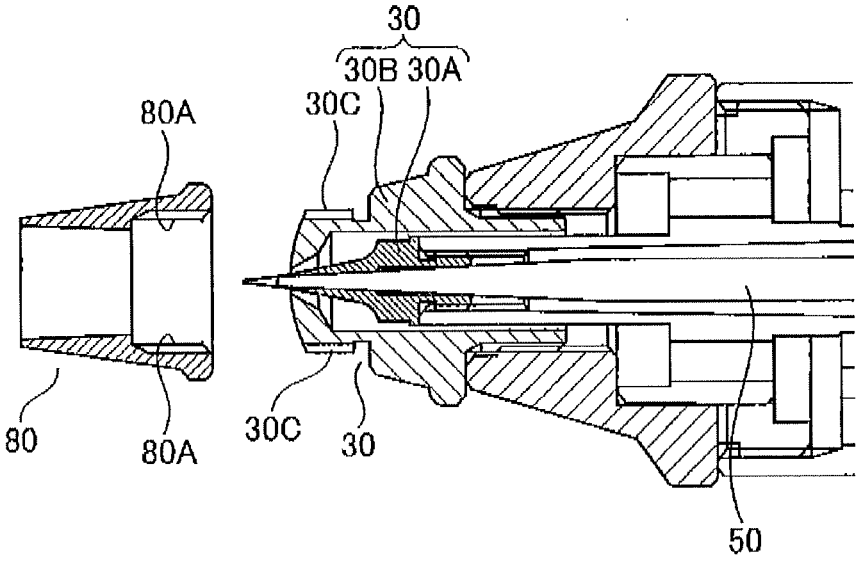
FIG. 3B is a cross-sectional view taken along the line IIIb-IIIb of FIG. 2B.

FIG. 3A illustrates a cross-sectional view taken along the line IIIa-IIIa of FIG. 2A, and FIG. 3B illustrates a cross-sectional view taken along the line IIIb-IIIb of FIG. 2B. As illustrated in FIGS. 3A and 3B, the inner periphery of the needle cap 80 is provided with a female screw 80A. The outer periphery of the nozzle 30 is provided with a male screw 30C. When the female screw 80A is threaded into the male screw 30C of the nozzle 30, the needle cap 80 is attached to the nozzle 30 (see FIG. 3A). Then, when the threading of the female screw 80A with respect to the male screw 30C of the nozzle 30 is released, the needle cap 80 is separated from the nozzle 30 (see FIG. 3B). Furthermore, the needle cap 80 is famed of any one of metal and resin.

<Needle Cap Attachment Portion 90>

Returning to FIG. 1, the rear end of the airbrush body 20 is provided with the needle cap attachment portion 90. The needle cap attachment portion 90 includes a base 91 that is threaded into the axial portion of the airbrush body 20. A protrusion 92 is formed at the center axis of the base 91. The outer periphery of the protrusion 92 is provided with a male screw 92A (see FIG. 5). The female screw 80A of the needle cap 80 is threaded into the male screw 92A of the protrusion 92. A hole 91H is formed along the center axis of the base 91. The needle 50 is inserted into the hole 91H so as to be supported thereto. The base 91 is provided with an outer cylindrical body 93 which surrounds the protrusion 92 while having a gap with respect to the protrusion 92. An inner cylindrical body 94 is disposed between the protrusion 92 and the outer cylindrical body 93. A coil spring 95 is disposed between the inner cylindrical body 94 and the base 91.

The inner cylindrical body 94 is formed in a shape in which a hole 94A is formed at the center of the bottom portion of the bottomed cylindrical body. The protrusion 92 is fixed while a bar portion 92P formed therein passes through the hole 94A of the bottomed cylindrical body and the coil spring 95 and is inserted into the hole 91H formed in the base 91. Accordingly, the inner cylindrical body 94 is disposed so as to cover the side surface provided with the male screw 92A of the protrusion 92 by the repelling force of the coil spring 95. Then, when the inner cylindrical body 94 is pushed toward the base 91 against the repelling force of the coil spring 95, the male screw 92A of the protrusion 92 may be exposed from the inner cylindrical body 94.

Figure 4A:
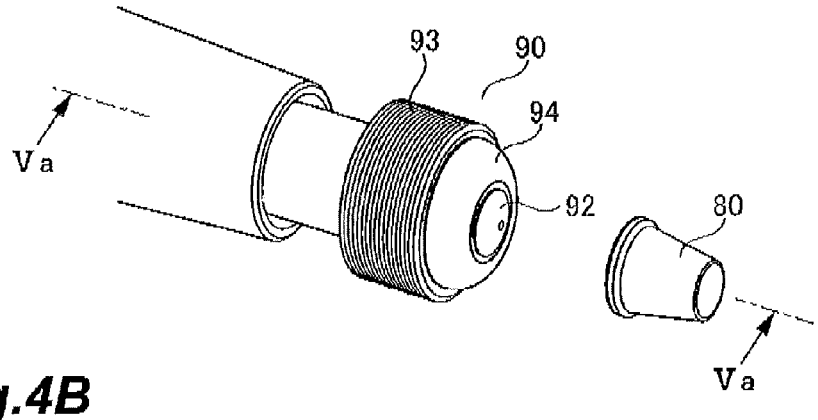
FIGS. 4A, 4B, and 4C are views illustrating a procedure in which a needle cap is temporarily attached to a needle cap attachment portion formed in the airbrush.
Figure 4B:
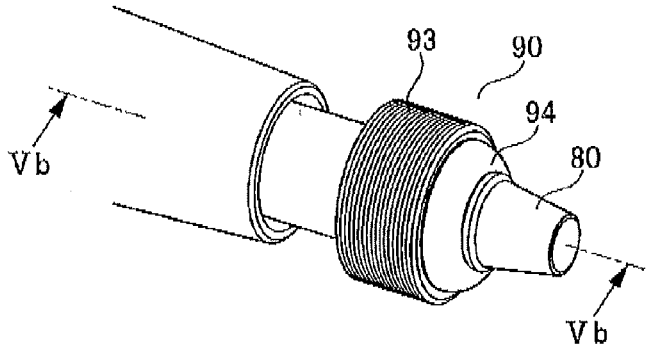
Figure 4C:
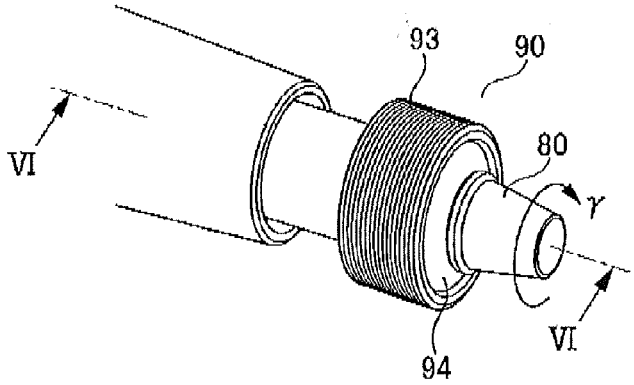
Figure 5A:
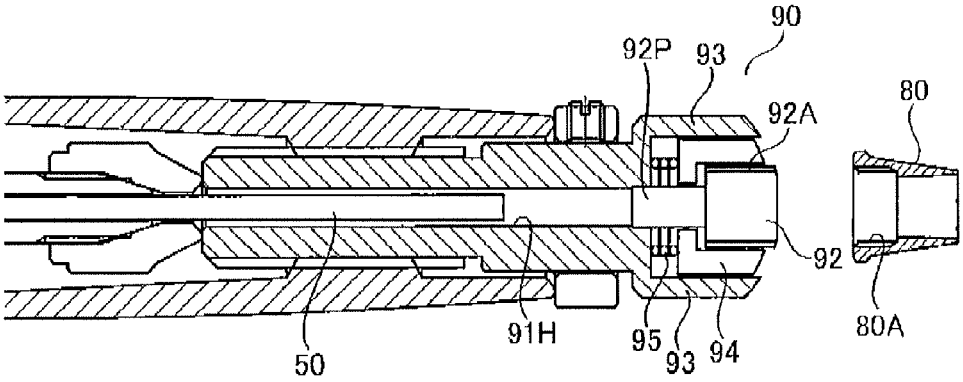
FIG. 5A is a cross-sectional view taken along the line Va-Va of FIG. 4A.

FIGS. 4A, 4B, and 4C are views illustrating a procedure in which the needle cap 80 is temporarily attached to the needle cap attachment portion 90. FIG. 4A illustrates the needle cap attachment portion 90 to which the needle cap 80 is not attached thereto. The protrusion 92, the inner cylindrical body 94, and the outer cylindrical body 93 forming the needle cap attachment portion 90 are formed so that the rear end surfaces thereof are substantially and smoothly continuous to one another. These rear end surfaces are formed as curved surfaces in consideration of the good appearance thereof. FIG. 5A is a view illustrating a cross-section taken along the line Va-Va of FIG. 4A. The inner cylindrical body 94 is disposed so as to cover the side surface provided with the male screw 92A of the protrusion 92 by the coil spring 95.

Figure 5B:
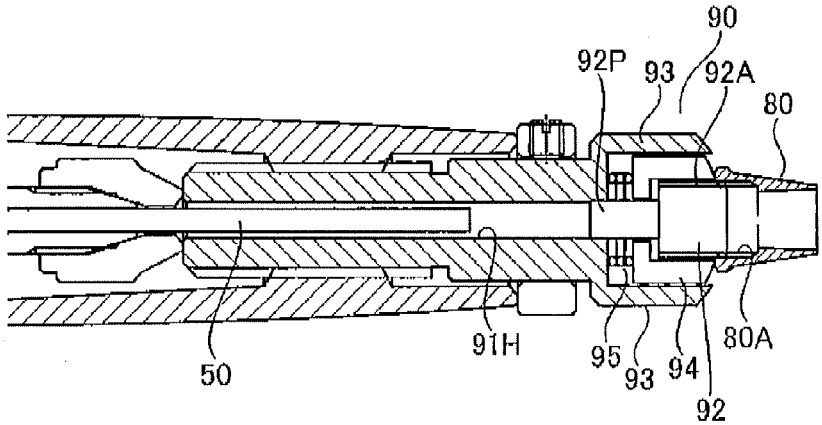
FIG. 5B is a cross-sectional view taken along the line Vb-Vb of FIG. 4B.

FIG. 4B illustrates the needle cap attachment portion 90 immediately before the needle cap 80 is threaded into the protrusion 92. One end of the needle cap 80 comes into contact with the inner cylindrical body 94 so as to cover the protrusion 92. FIG. 5B is a view illustrating a cross-section taken along the line Vb-Vb of FIG. 4B. The protrusion 92 and the needle cap 80 are coaxially disposed.

Figure 6:
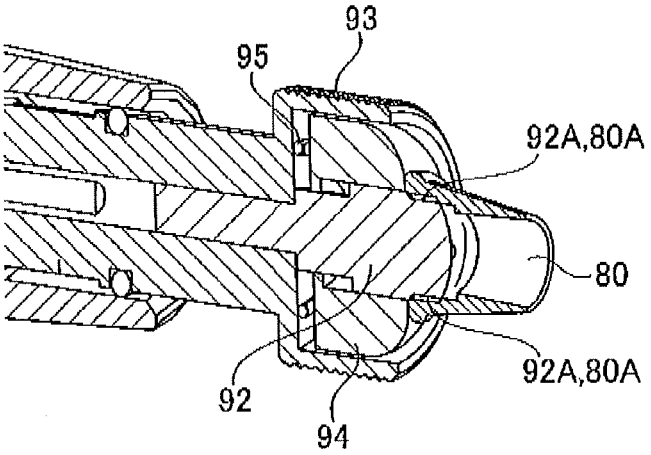
FIG. 6 is a cross-sectional view taken along the line VI-VI of FIG. 4C.

FIG. 4C illustrates the needle cap attachment portion 90 in a state where the needle cap 80 is rotated about the axis thereof (in a direction γ of the drawing). Accordingly, when the threading of the male screw 92A of the protrusion 92 into the female screw 80A of the needle cap 80 starts, the needle cap 80 starts to push the inner cylindrical body 94 against the repelling force of the coil spring 95. Accordingly, the needle cap 80 is threaded into the protrusion 92, so that the needle cap 80 is temporarily attached to the needle cap attachment portion 90. FIG. 6 is a perspective view illustrating a cross-section taken along the line VI-VI of FIG. 4C. It is obvious that the female screw 80A of the needle cap 80 is threaded into the male screw 92A of the protrusion 92.

As obvious from the description above, according to the airbrush 10 of the present invention, the needle cap 80 separated from the nozzle 30 may be simply and temporarily attached to the needle cap attachment portion 90 instantly. Accordingly, the needle cap 80 may not be easily lost.

(Second Embodiment)

Figure 7A:
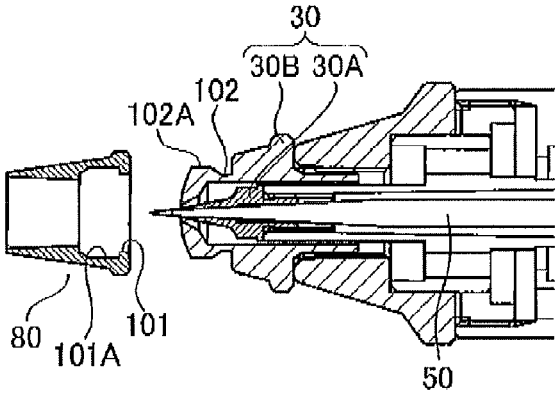
FIGS. 7A, 7B, and 7C are views illustrating a configuration of a second embodiment of the airbrush of the present invention.
Figure 7B:
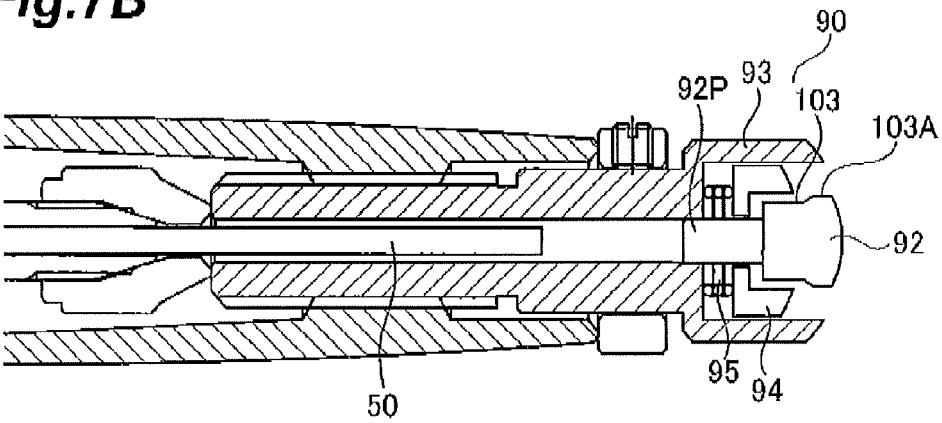
Figure 7C:
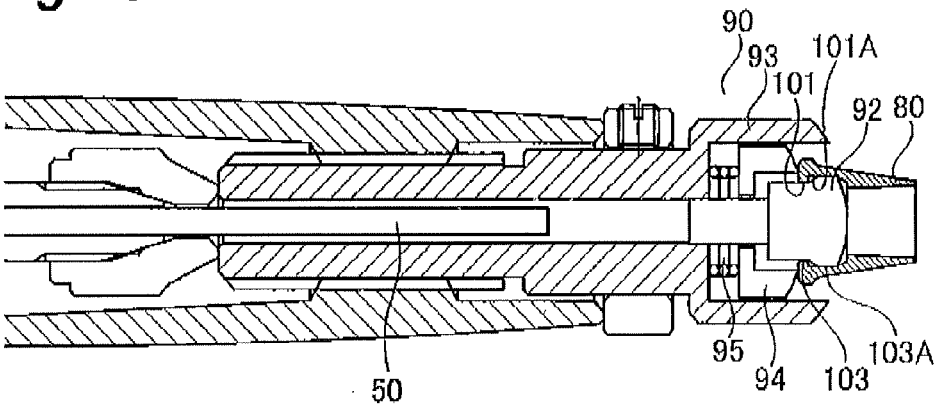

In the first embodiment, the needle cap 80 is attached to the nozzle 30 by threading, and is temporarily attached to the needle cap attachment portion 90 by threading. However, the present invention is not limited to the dreading. The needle cap 80 may be attached or temporarily attached by fitting. FIGS. 7A, 7B, and 7C are views illustrating an airbrush of a second embodiment with such a configuration. FIG. 7A is a view corresponding to FIG. 3A. The rear end of the inner peripheral surface of the needle cap 80 separated from the nozzle 30 is provided with a convex portion 101 which is formed along the inner periphery thereof. Accordingly, the tip side of the inner peripheral surface of the needle cap 80 is provided with a concave portion 101A. Further, the outer peripheral surface of the nozzle 30 is provided with a concave portion 102 which is formed along the outer periphery thereof. Accordingly, a convex portion 102A is formed in the outer peripheral surface at the tip side of the nozzle 30 in relation to the concave portion 102 thereof. The needle cap 80 is attached to the nozzle 30 in a manner such that the convex portion 101 and the concave portion 101A of the needle cap 80 are respectively fitted to the concave portion 102 and the convex portion 102A of the nozzle 30. FIG. 7B is a view corresponding to FIG. 5A, and the tip side of the outer peripheral surface of the protrusion 92 of the needle cap attachment portion 90 is provided with a concave portion 103 which is formed along the outer periphery thereof. Accordingly, the rear end of the inner peripheral surface of the protrusion 92 is provided with a convex portion 103A. As in the case of FIG. 5B, the concave portion 103 and the convex portion 103A of the protrusion 92 are normally covered by the inner cylindrical body 94 that moves by the biasing force of the coil spring 95. FIG. 7C is a view corresponding to FIG. 5B, and is a view illustrating a case where the needle cap 80 separated from the nozzle 30 is temporarily attached to the needle cap attachment portion 90. As illustrated in FIG. 7C, the convex portion 103A and the concave portion 103 fanned in the outer peripheral surface of the protrusion 92 are exposed by the movement of the inner cylindrical body 94 against the coil spring 95, and the convex portion 101 and the concave portion 101A of the needle cap 80 are respectively fitted to the concave portion 103 and the convex portion 103A of the protrusion 92 of the needle cap attachment portion 90, so that the needle cap 80 is temporarily attached to the needle cap attachment portion 90.

(Third Embodiment)

Figure 8A:
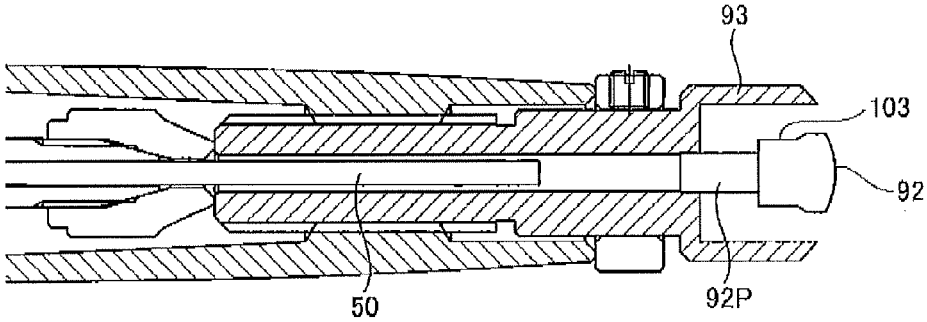
FIGS. 8A and 8B are views illustrating a configuration of a third embodiment of the airbrush of the present invention.
Figure 8B:
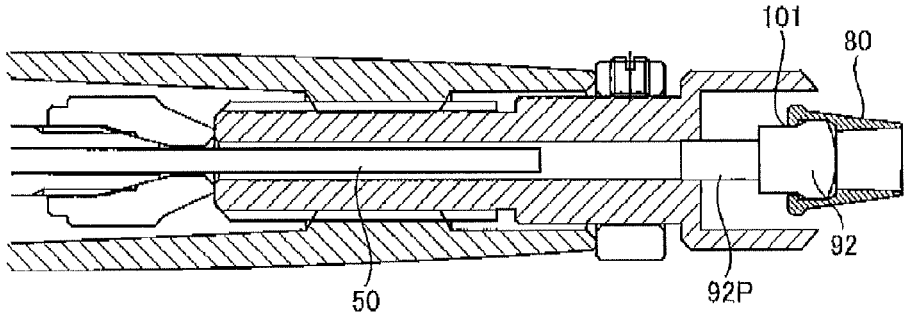

In the second embodiment, the needle cap attachment portion 90 is provided with the coil spring 95 and the inner cylindrical body 94. However, the present invention is not limited thereto, and the coil spring 95 and the inner cylindrical body 94 may not be provided. FIG. 8A is a view corresponding to FIG. 7B, and FIG. 8B is a view corresponding to FIG. 7C. As illustrated in FIGS. 8A and 8B, the coil spring 95 and the inner cylindrical body 94 are riot provided compared to FIGS. 7B and 7C. Then, the other configurations are the same as those of FIGS. 7B and 7C.

(Fourth Embodiment)

Figure 9A:
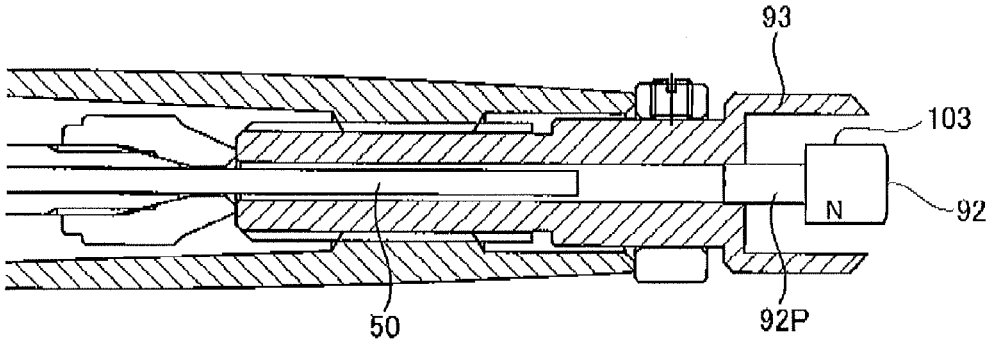
FIGS. 9A and 9B are views illustrating a configuration of the third embodiment of the airbrush of the present invention.
Figure 9B:
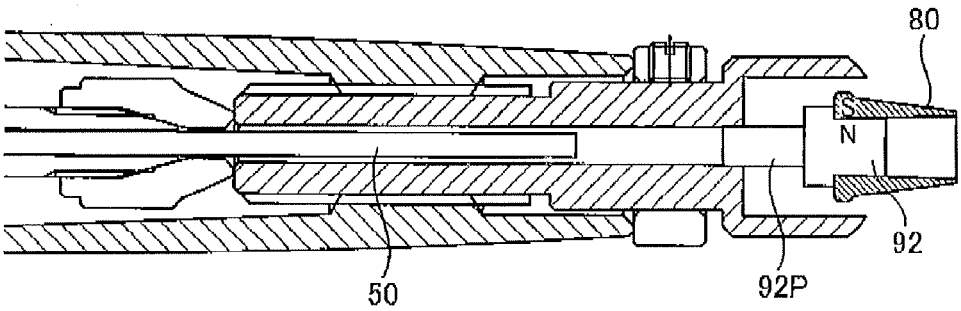

In the first to third embodiments, the attachment and the temporary attachment of the needle cap 80 with respect to the nozzle 30 and the needle cap attachment portion 90 are performed by threading or fitting. However, the present invention is not limited thereto, and the attachment and the temporary attachment of the needle cap 80 with respect to the nozzle 30 and the needle cap attachment portion 90 may be performed by the adsorption of the magnet. FIGS. 9A and 9B are views respectively corresponding to FIGS. 8A and 8B. As illustrated in FIGS. 9A and 9B, the protrusion 92 of the needle cap attachment portion 90 is formed of a magnetic body (magnet) so that the surface thereof becomes, for example, an N (s) pole. Furthermore, although not illustrated in the drawings, the nozzle 30 (see FIG. 1) is also formed of a magnetic body (magnet) so that the surface thereof becomes an N (S) pole. Meanwhile, the needle cap 80 is formed of a magnetic body (magnet) so that the inner peripheral surface becomes, for example, an S (N) pole. In such a case, the attachment and the temporary attachment of the needle cap 80 with respect to the nozzle 30 and the needle cap attachment portion 90 may be performed with high reliability without preparing a particular design in the needle cap 80, the nozzle 30, and the needle cap attachment portion 90. In this case, the needle cap 80, the nozzle 30, and the needle cap attachment portion 90 do not need to be formed of a magnet, and a part thereof may be formed of a magnet. Then, the attachment and the temporary attachment of the needle cap 80 with respect to the nozzle 30 and the needle cap attachment portion 90 using the magnet may be applied to the configurations of the first embodiment and the second embodiment.

(Fifth Embodiment)

A so-called pencil type airbrush comprising an operation rod is described in the first to fourth embodiments. However, the present invention is not limited thereto, and may be also applied to a so-called gun type airbrush, for example, comprising a trigger instead of the operation rod.

While the present invention has been described by using the embodiments, it is needless to mention that the technical scope of the present invention is not limited to the scope of the embodiments. It is obvious that various modifications or improvements may be made in the above-described embodiments by the person skilled in the art. Further, it is obvious that the modifications or the improvements are also included in the technical scope of the present invention from claims.

What is claimed is:

1. An airbrush comprising:

an airbrush body;

a nozzle that is provided at a tip of the airbrush body so as to spray paint and air;

a needle cap that is separably attached to the nozzle; and a needle cap attachment portion that is provided at a rear end of the airbrush body so as to temporarily attach the needle cap separated from the nozzle thereto, wherein the needle cap attachment portion includes a protrusion with means for temporarily attaching the needle cap to the outer periphery thereof, wherein the inner periphery of the needle cap is provided with a female screw threaded into a male screw formed in the outer periphery of the nozzle, wherein the outer periphery of the protrusion is provided with a male screw threaded into the female screw of the needle cap, wherein the needle cap attachment portion further includes an outer cylindrical body that surrounds the protrusion, an inner cylindrical body that is disposed between the outer cylindrical body and the protrusion, and a coil spring that is disposed between the airbrush body and the inner cylindrical body, and wherein when the inner cylindrical body is pushed toward the airbrush body against a biasing force of the coil spring, the male screw of the protrusion is exposed.

* * * * *